US007017301B2

(12) United States Patent
Balbo Di Vinadio

(10) Patent No.: US 7,017,301 B2
(45) Date of Patent: Mar. 28, 2006

(54) TRANSMISSION ROD FOR ACCESSORIES FOR WINDOWS AND DOORS

(75) Inventor: Aimone Balbo Di Vinadio, Turin (IT)

(73) Assignee: Savino Spa, Turin (IT)

( * ) Notice: Subject to any disclaimer, the term of this patent is extended or adjusted under 35 U.S.C. 154(b) by 5 days.

(21) Appl. No.: 10/876,020

(22) Filed: Jun. 25, 2004

(65) Prior Publication Data

US 2005/0022941 A1 Feb. 3, 2005

(30) Foreign Application Priority Data

Jun. 27, 2003 (IT) ..... TO2003A0488

(51) Int. Cl.
*E05D 15/52* (2006.01)

(52) U.S. Cl. ..... 49/192

(58) Field of Classification Search ..... 49/192, 49/193, 191, 176

See application file for complete search history.

(56) References Cited

U.S. PATENT DOCUMENTS 4,679,352 A * 7/1987 Bates ..... 49/192
4,684,140 A * 8/1987 Olivieri ..... 280/11.26
4,739,583 A * 4/1988 Tonsmann et al. ..... 49/192
5,226,256 A * 7/1993 Fries et al. ..... 49/13
5,881,498 A * 3/1999 Goggin et al. ..... 49/192

* cited by examiner

*Primary Examiner*—David Purol
(74) *Attorney, Agent, or Firm*—Sughrue Mion, PLLC

(57) ABSTRACT

A transmission rod for accessories for windows and doors having a first and a second end provided with respective connectors. The transmission rod has a first elongated element having the first end and a second elongated element having a second end. The first and second elongated elements can be mutually fastened in a plurality of selected positions corresponding to a plurality of effective lengths for the transmission rod.

1 Claim, 4 Drawing Sheets

TRANSMISSION ROD FOR ACCESSORIES FOR WINDOWS AND DOORS

BACKGROUND OF THE INVENTION

The present invention relates to a transmission rod for accessories for windows and doors.

Accessories for windows and doors are divided in two large categories, according to the material constituting the window or door: accessories for wooden or PVC windows and doors and accessories for aluminium windows or doors. The main difference is due to the fact that aluminium windows and doors have grooves with considerably greater structural capacities than those of the grooves of wood or PVC windows and doors. Consequently, whilst accessories for wood and PVC windows and doors must be provided with a support and guide structure with a structural function, accessories for aluminium windows and doors exploit the structural capacity of the guides of the window or door.

In the field of accessories for aluminium windows and doors, transmission rods are used which connect the various accessories of the window or door to each other. In particular, in the case of windows that can rotate both about a vertical axis and about a horizontal axis, transmission rods are provided for connecting the opening/closing device to an upper angular transmission and to a lower angular transmission. Also provided is a transmission rod for connecting the upper angular transmission to a scissors arm and a transmission rod connected to the lower angular transmission. An additional rod, connected to an angular transmission for supplementary closure, can also be provided.

Each transmission rod is provided at it ends with connecting means. For example, such connecting means can be formed by holes able to engage pivot pins provided on the accessories.

The length of the transmission rods depends on the dimensions of the window or door and on the position of the opening and closing device. In more traditional solutions, transmission rods are obtained starting from a continuous strip of metallic or plastic material wherefrom are cut segments with the desired length. After the cut, in each transmission rod are formed connecting holes at the two ends by punching or drilling. The cut to measure and the punching or drilling of the transmission rods are performed by the manufacturer of the windows or doors. Said operations are time consuming for the manufacturer and require dedicated machines.

The document EP-A-1 227 207 describes accessories for windows comprising a support piece connected at its ends to a pair of transmission rods. The support piece is connected to each transmission rod by means of mutually engaged toothed parts, i.e. a toothed part at the end of the transmission rod and a toothed part at the end of the support piece. The toothed coupling between the support piece and the transmission rod, however, allows a relatively reduced amplitude adjustment, so the window and door manufacturer must have available an assortment of rods with different lengths to cover all production requirements.

SUMMARY OF THE INVENTION

The object of the present invention is to provide a transmission rod for accessories for aluminium windows and doors which allows to overcome the drawbacks of the prior art.

According to the present invention, said object is achieved by a transmission rod having the characteristics set out in the claims.

BRIEF DESCRIPTION OF THE DRAWINGS

The present invention shall now be described in detail with reference to the accompanying drawings, provided purely by way of non limiting example, in which.

DETAILED DESCRIPTION OF THE INVENTION

Figure 1:
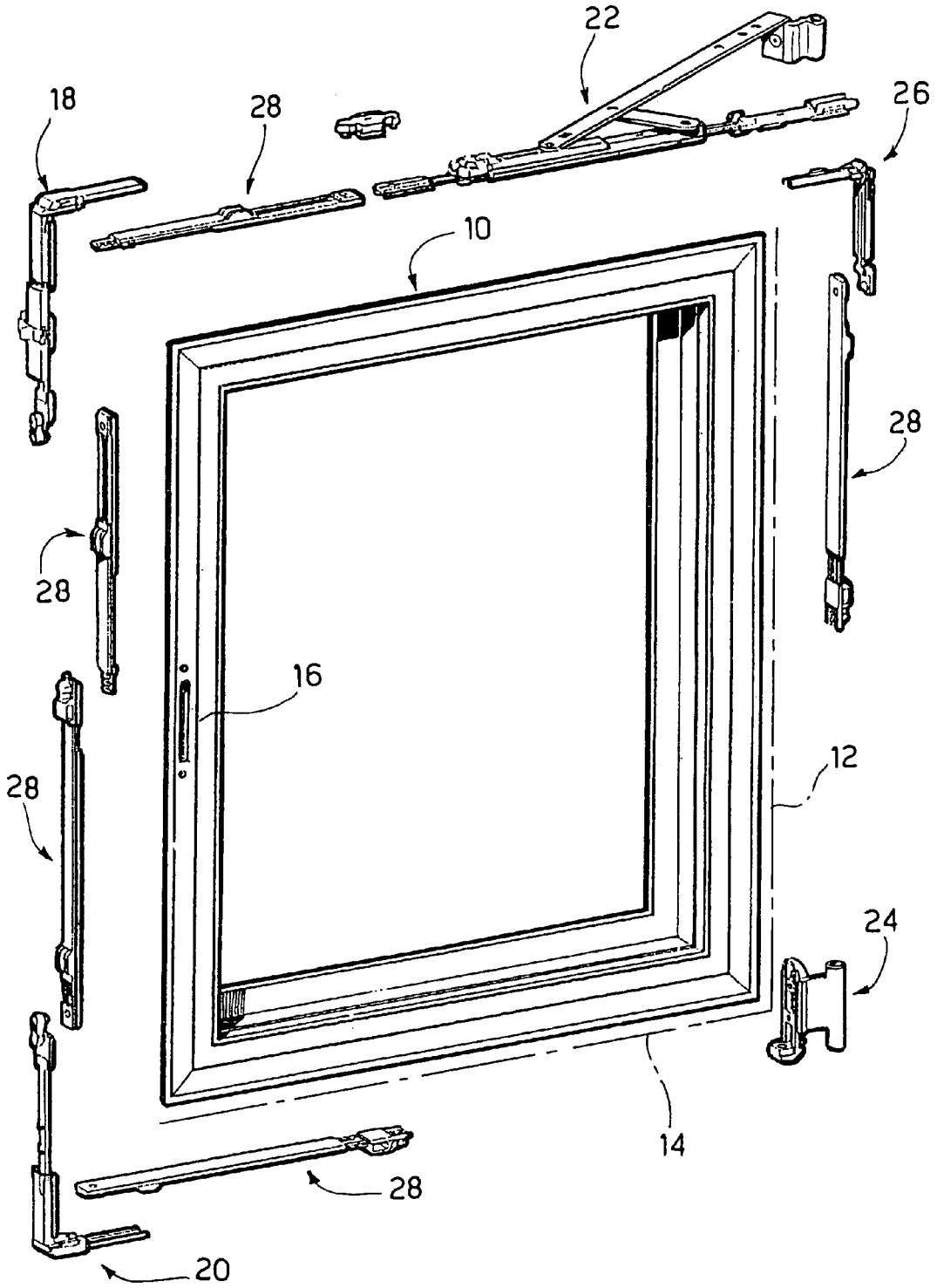
FIG. 1 is an exploded perspective view showing a window provided with a series of accessories connected to each other by means of a plurality of transmission rods according to the present invention.

With reference to FIG. 1, the reference number 10 designates an openable wing of a window of the type rotatable about a vertical axis 12 and tiltable about a horizontal axis 14. The wing 10 is formed, in known fashion, by aluminium section bars provided with undercut grooves. On the side 16 of the wing 10 is mounted an actuation device (not shown) with its handle.

FIG. 1 schematically shows the accessories that allow to obtain the rotation motion about the axes 12 and 14. Said accessories comprise an upper angular transmission 18, a lower angular transmission 20, a scissors arm 22, a lower hinge 24 and an angular transmission 26 for a supplementary closure. The accessories 18, 20, 22, 24 and 26 are known in themselves and a detailed description of their structure and of their operation is outside the scope of the present invention.

The accessories 18, 20, 22 and 26 are operatively associated to a plurality of transmission rods 28 according to the present invention.

Figure 2:
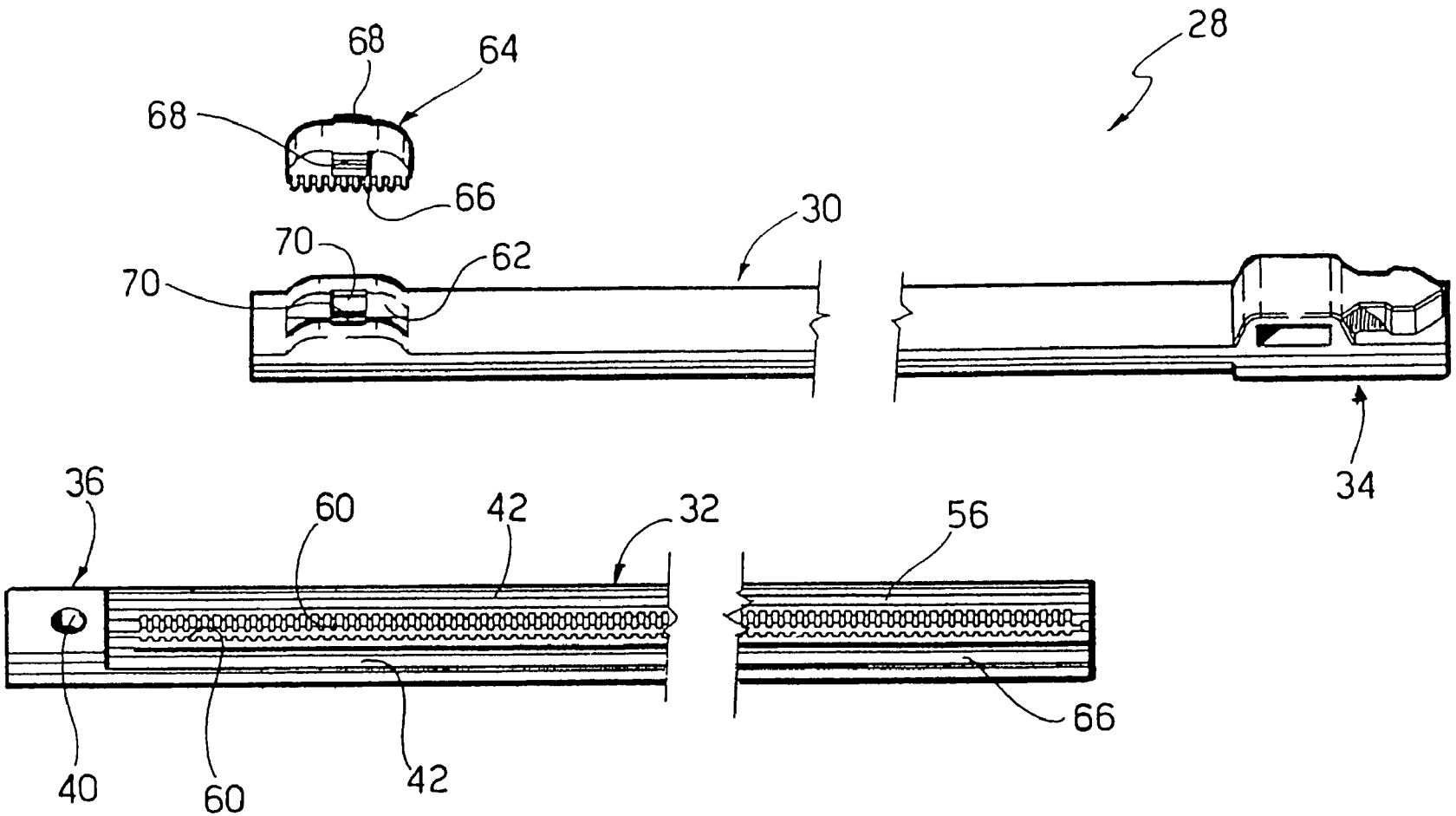
FIG. 2 is an exploded perspective view of a transmission rod according to the present invention.
Figure 3:
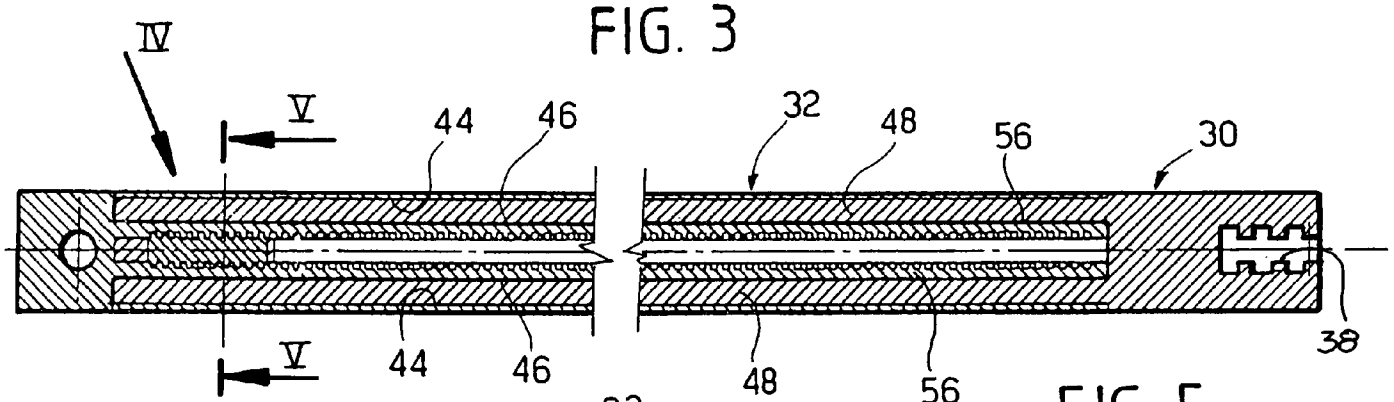
FIG. 3 is a horizontal section of the rod of FIG. 2.

With reference to FIG. 2, each transmission rod 28 comprises a first elongated element 30 and a second elongated element 32 mutually coupled in telescopic fashion. Each elongated element 30, 32 has an end portion 34, 36 provided with a fastening means 38, 40. The fastening means 38, 40 can be of various types. In the example illustrated in FIGS. 2 and 3, the fastening means 38 is a groove visible in FIG. 3, to be coupled with a complementarily shaped projection of a complementary fastening means provided on the accessories whilst the fastening means 40 is simply a hole able to be engaged by a pivot pin. The two elongated elements 30, 32 can be provided with identical or different fastening means, e.g. both can be provided with holes 40 or with identical or complementary protuberances/cavities. The type and shape of the fastening means can also vary as a function of the shape of the fastening means provided on the accessories whereto the transmission rods must be connected.

The telescopic connection between the elongated elements 30, 32 allows to adjust the distance between the fastening means 38, 40 between a minimum value and a maximum value. The distance between the fastening means 38, 40 constitutes the effective length of the transmission rod 28. The two elongated elements 30, 32 are destined to be fastened to each other in a selected position, whereto corresponds a desired effective length.

The elongated elements 30, 32 are preferably constituted by injection moulded plastic material. The elongated elements 30, 32 are provided with mutually co-operating guiding means, which achieve the telescopic connection. A possible embodiment of said guiding means is illustrated with reference to FIGS. 3 and 5. With reference to these figures, the second elongated element 32 has a pair of mutually parallel longitudinal guiding grooves 42 which extend in proximity to its lateral edges. Each groove 42 is substantially U shaped with an outer wall 44 and an inner wall 46. The first elongated element 30 has two longitudinal walls 48 whose ends 50 slidably engage in longitudinal direction the guiding grooves 42. Preferably, a connection is provided that prevents the disengagement between the elongated elements 30, 32 orthogonally to their direction of relative sliding. This stop can, for example, be formed by a protuberance 52 formed on the inner wall 46 of each groove 42, which engages a shallow groove 54 extending longitudinally on the inner side of each lateral wall 48 of the first elongated element 30.

The elongated elements 30, 32 are provided with a lock system able to fasten said elements to each other in a predetermined position whereto corresponds the desired effective length of the transmission rod 28.

The locking system for the relative fastening between the elements 30, 32 can assume various forms. A preferred embodiment of the locking system is described below with reference to FIGS. 2 through 5. The second elongated element 32 has two parallel longitudinal ribs 56 whose outer walls form the inner walls 46 of the guiding grooves 42. The inner longitudinal ribs 56 face each other and define a longitudinal channel 58. The mutually facing inner walls of the ribs 56 are provided with respective teeth 60 which preferably extend over the entire length of the longitudinal ribs 56.

Figure 5:
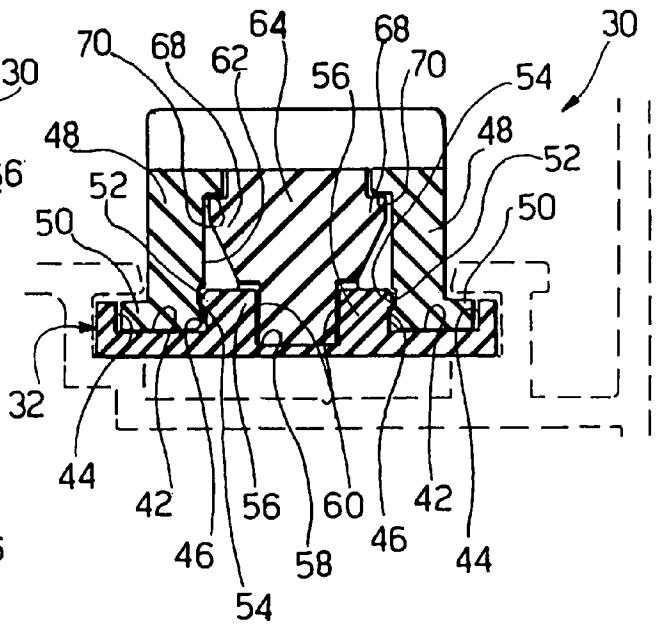
FIG. 5 is a section according to the line V—V of FIG. 3, and FIGS. 6 and 7 are plan views showing a transmission rod according to the present invention respectively in the position of minimum and maximum effective length.
Figure 4:
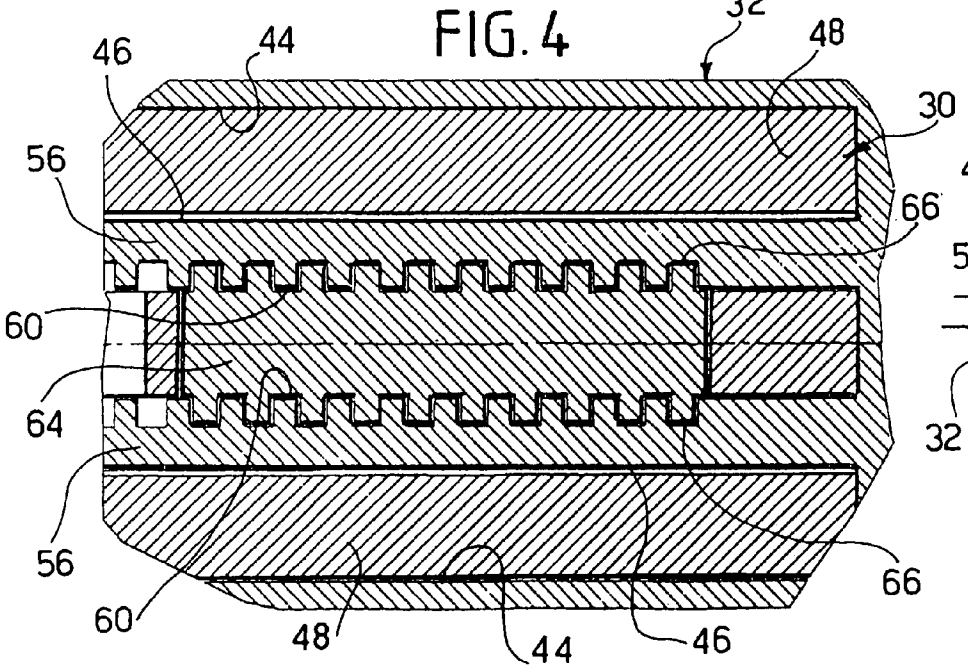
FIG. 4 is a detail in enlarged scale of the part designated by the arrow IV in FIG. 3.

The first elongated element 30 is provided with a through opening 62 situated at the opposite end relative to the end portion 34 bearing the fastening means 38. The through opening 62 receives a locking member 64 provided on two opposite sides with teeth 66 able to engage the teeth 60 of the second elongated element 32. Preferably, the locking member 64 is inserted in snap-on fashion into the opening 62, by means of the edges of the opening 62. As shown in FIG. 5, when the locking member 64 is inserted into the opening 62, the engagement of teeth 68 with surfaces 70 formed in the opening 62 holds in snap-on fashion the locking member 64. The teeth 66 of the locking member 64 engage corresponding portions of the teeth 60 of the second elongated element 32, so the locking member prevents the relative motion between the first and the second elongated element 30, 32.

In use, the manufacturer of windows or doors sets the desired effective length of the transmission rod 28 making the two elongated elements 30, 32 slide relative to each other. When the effective length of the transmission rod 28 corresponds to the desired length, the rod 28 is locked by the insertion of the locking member 64 into the opening 62. To vary the length of the transmission rod 28, it is necessary to extract the locking member 64.

Figure 6:
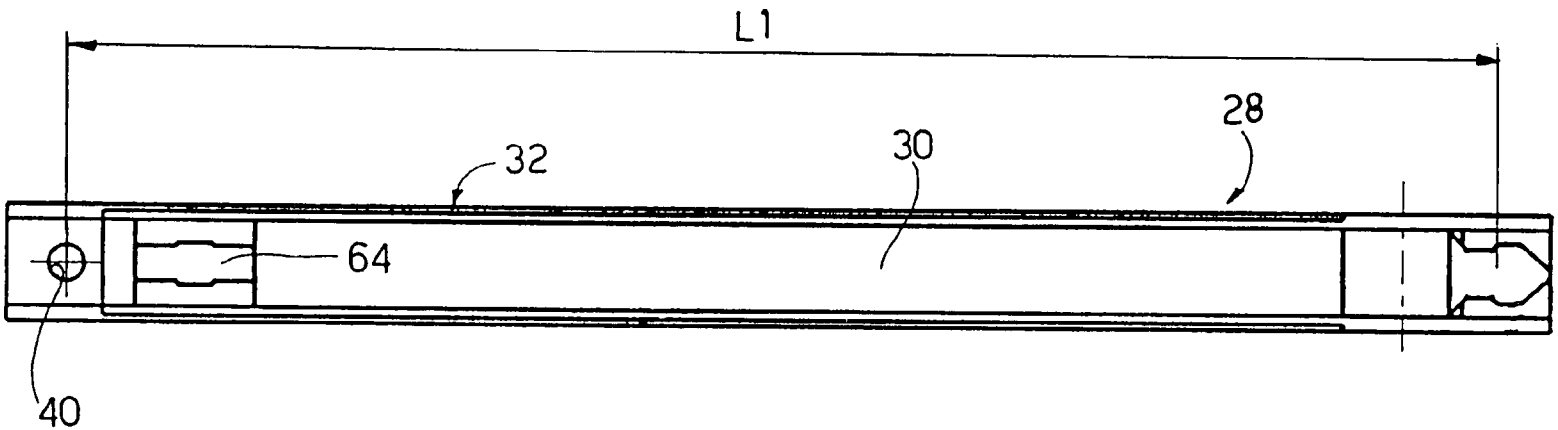
Figure 7:
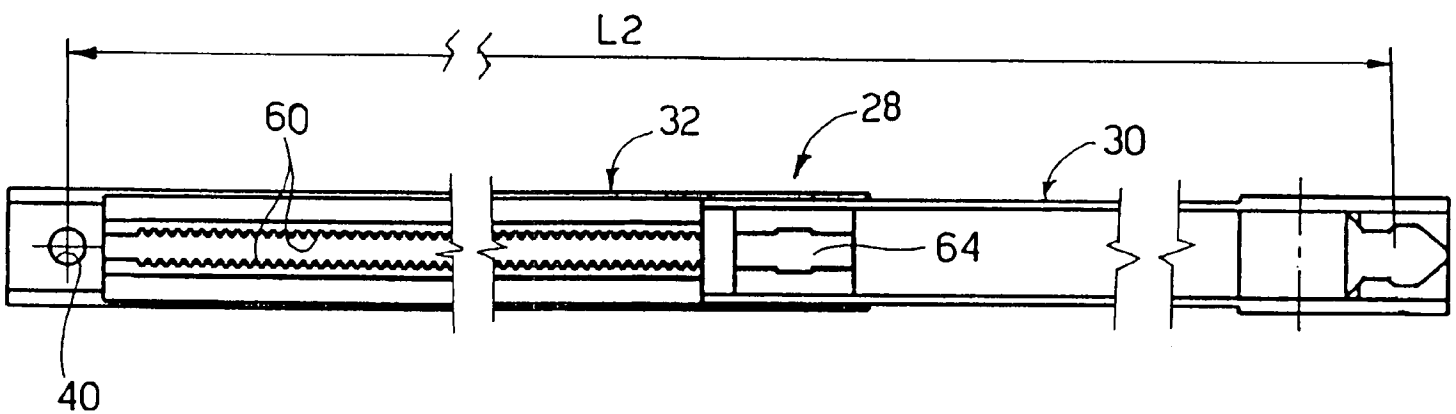

FIGS. 6 and 7 show a plan view of a transmission rod according to the present invention in two possible positions. FIG. 6 shows the condition in which the transmission rod 28 has the minimum effective length, designated by the reference L1. FIG. 7 shows the position in which the transmission rod 28 has the maximum effective length L2. The rod 28 can assume a plurality of positions with intermediate effective lengths between the lengths L1 and L2. The adjustment pitch of the effective length of the transmission rod 28 is equal to the pitch of the teeth 60. Naturally, the present invention may be subject to numerous variants without thereby departing from the scope of the present invention. For example, the relative fastening between the first and the second elongated element 30, 32 may be achieved by means of pressure fastening devices which do not require the use of the toothed coupling.

What is claimed is:

1. A transmission rod for connecting window operating accessories comprising a first elongated element having first connector means at one end for connecting said first elongated element to a first window operating accessory, a second elongated element having first connector means at one end for connecting said second elongated element to a second window operating accessory, said first and second elongated elements being telescopically inter-fitted for sliding relative motion with respect to each other wherein the second elongated element is provided with a plurality of teeth extending along substantially the entire length of the second elongated element and wherein a locking element is detachably connected in a snap-on manner in an opening in an opposite end of said first elongated element for selective engagement with the teeth on the second elongated element to lock the first and second elongated elements together.

* * * * *

UNITED STATES PATENT AND TRADEMARK OFFICE

CERTIFICATE OF CORRECTION

PATENT NO. : 7,017,301 B2
APPLICATION NO. : 10/876020
DATED : March 28, 2006
INVENTOR(S) : Aimone Balbo Di Vinadio It is certified that error appears in the above-identified patent and that said Letters Patent is hereby corrected as shown below:

Title Page, item
(73) Assignee: should read Savio Spa, Turin (IT)

Signed and Sealed this

Twenty-fifth Day of July, 2006

JON W. DUDAS
*Director of the United States Patent and Trademark Office*